US006035891A

United States Patent [19]

Hawkins, Jr. et al.

[11] Patent Number: 6,035,891

[45] Date of Patent: Mar. 14, 2000

[54] EMERGENCY AIR SYSTEM

[76] Inventors: Albert D. Hawkins, Jr., 21 Oaknoll Ct., Elma, N.Y. 14059-9336; Steven J. Herberholt, 10352 Golterman Dr., St. Louis, Mo. 63126

[21] Appl. No.: 09/040,902

[22] Filed: Mar. 18, 1998

Related U.S. Application Data

[62] Division of application No. 08/684,016, Jul. 19, 1996, Pat. No. 5,730,121.

[51] Int. Cl.[7] ..... E03B 7/07

[52] U.S. Cl. ..... 137/560; 137/342; 137/614.04; 285/124.1; 285/320

[58] Field of Search ..... 251/149.6, 149.7; 137/614.04, 342, 560, 343; 285/320, 124.1

[56] References Cited

U.S. PATENT DOCUMENTS

| | | | |
|---|---|---|---|
| 417,795 | 12/1889 | Starr . | |
| 1,109,318 | 9/1914 | Browne et al. . | |
| 1,176,146 | 3/1916 | Jones . | |
| 2,486,427 | 11/1949 | Miller et al. | 137/342 |
| 2,510,125 | 6/1950 | Meakin . | |
| 2,628,850 | 2/1953 | Summerville . | |
| 2,701,147 | 2/1955 | Summerville . | |
| 3,276,446 | 10/1966 | Hay . | |
| 4,304,229 | 12/1981 | Curtin | 128/201.11 |
| 4,394,861 | 7/1983 | Sciortino | 128/205.25 |
| 4,445,536 | 5/1984 | Willis | 251/149.7 |
| 4,555,130 | 11/1985 | McClain | 285/26 |
| 4,611,831 | 9/1986 | Truchet | 285/26 |
| 4,900,065 | 2/1990 | Houck | 295/73 |
| 4,915,419 | 4/1990 | Smith, III | 285/26 |
| 4,982,736 | 1/1991 | Schhneider | 251/149.7 |
| 5,150,880 | 9/1992 | Austin, Jr. et al. | 251/149.7 |
| 5,219,185 | 6/1993 | Oddenimo | 285/26 |
| 5,316,347 | 5/1994 | Arosio | 285/26 |
| 5,323,808 | 6/1994 | Shimizu | 137/614.04 |

FOREIGN PATENT DOCUMENTS

| | | |
|---|---|---|
| 152622 | 2/1938 | Austria . |
| 3615664 | 11/1986 | Germany . |
| 27392 | of 1909 | United Kingdom . |

*Primary Examiner*—A. Michael Chambers
*Attorney, Agent, or Firm*—Crossette & Associates

[57] ABSTRACT

The present invention is an improved system and apparatus for providing emergency breathing air upon the failure or disconnect of a primary air source in a hostile environment. The invention comprises a compressed air source interconnected with a primary pressurized system which automatically engages when the primary air system falls below a predefined pressure range and isolates the secondary system from the primary system.

16 Claims, 6 Drawing Sheets

EMERGENCY AIR SYSTEM

This is a divisional of application Ser. No. 08/684,016 filed on Jul. 19, 1996 now U.S. Pat. No. 5,730,121.

The present invention relates to a system for providing breathing air, under life-threatening emergency conditions, to a user otherwise trapped in a non-breathable atmosphere. The invention has utility in underwater and fouled air conditions and features an embodiment for automatic operation wherein the user is trapped upside down in water and so stricken as to be unable to assist in his rescue.

BACKGROUND OF THE INVENTION

Automobile, plane and motorized boat racing are sports which have enjoyed increasing popularity in modern times. As speeds increase so does the danger of accidents and the harm which might be visited upon the participants. In land and air vehicle racing a most feared danger is being trapped or otherwise incapacitated in the vehicle with toxic or otherwise non-breathable fumes fouling the air and causing asphyxiation. In motorized boat racing a most feared danger is being trapped or otherwise incapacitated underwater without a breathable air source.

The use of breathing devices in a non-breathable atmosphere is well known. Breathable air sources are commonly used in high altitude aircraft and generally involve complex systems which dispense oxygenated atmosphere from a bulky container mounted within the aircraft. In high speed auto and boat racing it is becoming more common for participants to use a similar complex system wherein a breathable atmosphere is dispensed to the participants from a bulky container mounted in the auto or boat. Portable but bulky breathing apparatus is commonly used in underwater diving and in fouled atmosphere conditions wherein the diver or worker has mounted to his back a bulky container of breathable air with a breathing mechanism which supplies air to the participant upon demand.

Such apparatus and systems however, generally demand that the user be in conscious control of his faculties and require a continuous tether to a compressed air container. In many emergency situations there is sudden, unexpected detachment from the tether and the user is immersed in an non-breathable atmosphere where he may be trapped or so stricken as to be unable to reattach to his breathable air life-line.

In order to guard against such unexpected situations, personal emergency breathable air containers have been proposed, which comprise a small compressed breathable air container generally conveniently carried by the user which can provide an emergency supply of breathable air. Such units are mounted and/or carried separate from the durable breathable air supply system and require the user to manually remove the container from it's mount, activate an appropriate valve system, remove parts of the durable system and manually regulate the personal breathable air supply to survive.

Unfortunately, such personal air containers and systems require at least some conscious participation by the user or other person, a requirement which may not be feasible in a sudden emergency situation where the user is restrained by being trapped or otherwise disoriented, unconscious or so stricken as to be unable to think or act appropriately.

It is an object of the present invention to provide a breathable air system which is convenient for use in durable operation.

It is another object of the invention to provide a breathable air system which can be easily disengaged from durable operation.

It is further object of the invention to provide a breathable air system which in an emergency situation will provide emergency breathable air sufficient for timely rescue from a non-breathable environment.

It is still another object of the invention to provide a release apparatus for disengaging a breathable air system from the user.

These and other objects of the invention will be apparent from the following description of the invention.

SUMMARY OF THE INVENTION

The present invention is an improved system and apparatus for providing breathing air in an emergency situation, wherein a secondary breathing air supply source, is interconnected with operative delivery means for supplying air from a durable primary air source and automatically engages upon sudden interruption of air flow from the durable primary air source.

In a general embodiment of the invention, the primary air supply source is continuous pressurized breathable air from a source such as a large air cylinder or the like which supplies breathable air to the user as is functionally appropriate for durable life support in a hostile breathing environment, for example 10 or more minutes of breathable air supply. The secondary breathing air source comprises a limited capacity compressed air source, such as a small cylinder or the like, which comprises an emergency supply of breathable air, for example less than about 10 minutes of breathable air supply. Such small container is interconnected with the durable life support delivery system of the primary air supply and is generally carried by and/or is conveniently mounted personal to the user.

The primary air source is delivered by operative delivery means to about the outlet of the user at a defined operative durable primary pressure. The secondary air source is interconnected along the operative delivery means supplying the primary air and a shut off means is positioned along the primary air operative delivery means between the point of interconnection and the primary air source. Flow from the secondary air source is controlled at a lower operative pressure than the defined operative durable primary pressure of the primary air supply, such that as long as air continues to flow from the primary supply air to maintain the primary operative durable pressure, air will not flow from the secondary supply. Upon reduction of primary operative durable pressure to about the lower operative pressure flow of the secondary source, air flows from the secondary source.

In a preferred embodiment, a shut-off means comprising a flow valve or the like, is located in the primary operative delivery system which automatically shuts off flow from and to the primary air source upon an emergency event, for example when the operative pressure imposed by the primary air source falls to a level about the operative pressure of the secondary air source or upon emergency manual activation.

In a further preferred embodiment, the primary air supply source comprises a compressed air cylinder or the like which is mounted within a vehicle such as a boat, airplane, auto or the like, and the user is harnessed or otherwise restrained in the vehicle releasable through a quick release mechanism which also functions to disengage air flow from the primary durable air supply. The secondary air supply source, comprises a small cylinder or the like of compressed air which is carried and/or mounted to the user and operatively supplies air to the user upon quick release of the harness and disengagement of the flow of air from the primary supply source.

In a most preferred embodiment, a face mask is fitted to the user for operative supply of breathable air from both the primary and secondary source, with the mask also comprising a user controlled ambient air supply means. Valve means (demand valve) is provided to enable positive breathable and/or on demand air flow, preferably so when the ambient air supply means is closed breathable air is automatically supplied to the user and when the ambient air supply is open, breathable air is continuous or intermittently supplied at user control.

In a further preferred embodiment, the user is restrained in position in the vehicle through harness means comprising a release mechanism for quickly releasing the harness restraint and simultaneously disengaging the primary air source from the operative primary air delivery system of the user.

In a still further preferred embodiment, a compressed air cylinder or the like comprising the primary durable air supply is harnessed to the user and a quick release device disengages the primary durable air source from the user.

In the improved system of the invention a primary air supply source, such as a compressed air cylinder or the like, is mounted to the user and/or vehicle and comprises a primary source valve means for controlling the flow of air from the primary source at a defined primary source pressure. Air flows through operative primary air supply hosing or the like from the source valve means through a quick release mechanism of the invention to the positive and/or demand valve means, arranged generally proximate the user outlet, functioning to supply air to the user upon respiratory demand. The primary air supply hosing between the primary source valve and the demand valve is sized to maintain air pressure from the primary air supply source within a defined normal primary hose pressure range during normal operation.

At a point along the primary air supply hosing between the demand valve and the quick release mechanism, a secondary air supply hose connects with the primary air supply hose which hose is in fluid connection at an opposite end to the secondary air supply source. The secondary air supply source comprises a secondary valve means for controlling the flow of air from the secondary air source at a defined secondary source pressure which is lower than the normal defined primary pressure range.

The quick release mechanism of the invention is operatively connected to maintain the user in restraining harness in the vehicle while coupling the primary air supply source in operative flow to the demand valve. In a further preferred embodiment, the quick release mechanism of the invention also comprises communication and/or liquid nourishment coupling means which coincidentally disengage upon quick release.

Disengagement of the release mechanism of the invention coincidentally releases the harness restraint, primary air source supply and other coupled functions arranged thereat. Valve means is provided to stop the reverse flow of air from the operative hose in communication with the secondary air source and mask, and in a preferred embodiment further valve means is provided to stop the flow of air from the primary source upon uncoupling.

In a preferred embodiment of the invention, particularly suitable for boat racing, the ambient air valve comprises means for automatically closing when the user is immersed in a water environment. In a particularly preferred embodiment the ambient valve comprises a ball valve means arranged so that upon contact with water, a water absorbing material expands to immediately push a ball to close an ambient air passageway and prevent the flow of water into a user mask.

DESCRIPTION OF THE DRAWINGS

The nature and mode of operation of the present invention is more fully described in the following detailed description of the accompanying drawings.

DETAILED DESCRIPTION OF THE DRAWINGS

Figure 3:
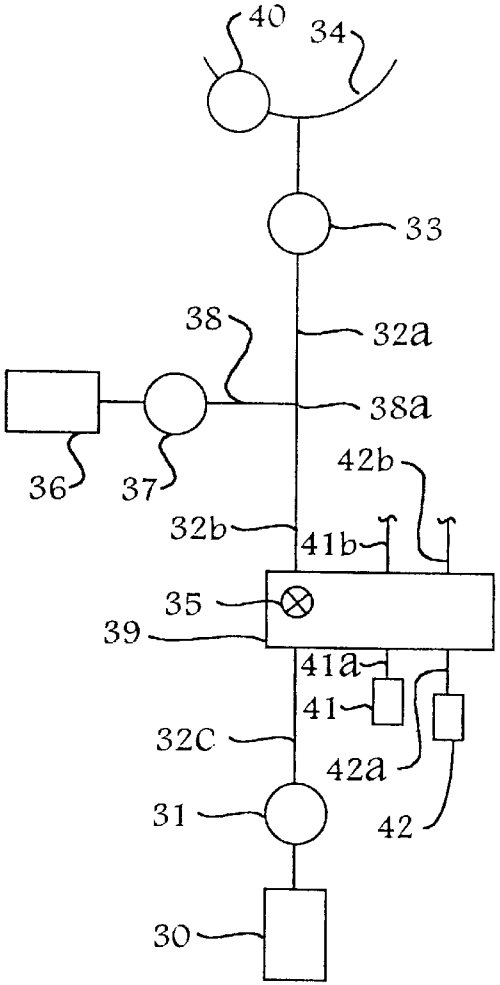
FIG. 3 is a schematic illustration of a further embodiment of the system of the invention.
Figure 2:
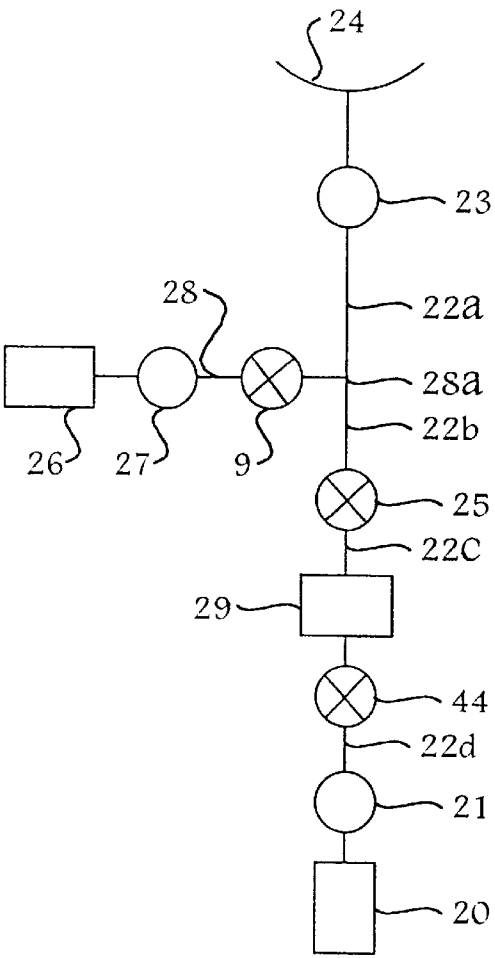
FIG. 2 is a schematic illustration of another embodiment of a system of the invention.
Figure 1:
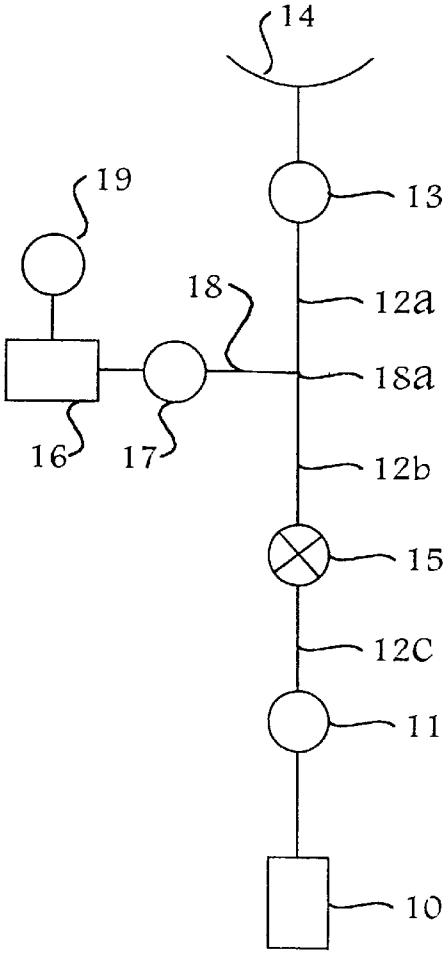
FIG. 1 is a schematic illustration of a system of the invention.

Referring first to FIGS. 1–3, therein are depicted various systems of the invention.

FIG. 1 illustrates a simple configuration of the system of the invention, wherein compressed air cylinder 10 comprises the primary air source being in fluid connection with pressure valve 11 which is arranged to meter air from compressed air cylinder 10 into primary pressure line 12*c*, 12*b* and 12*a* in a flow sufficient to maintain a pressure of about 25–35 psi within lines 12*a*, 12*b* and 12*c*. Demand valve 13 is positioned proximate to or at user interface 14, and is user respiratory demand operative. Thus, when the user inhales, valve 13 acts to allow flow of air from primary passageway 12*a* through the user interface and acts to restrain flow when the user holds a breadth or exhales.

Check valve 15 is arranged open, allowing the flow of air through primary pressure line 12*b* to line 12*a* when the pressure in line 12*a* is less than the pressure in line 12*b*. Compressed air cylinder 16 of the secondary air system is in fluid connection with pressure valve 17 which meters air from compressed air cylinder 16 into secondary pressure line 18 in a flow sufficient to maintain a pressure of about 10–15 psi within line 18. As secondary line 18 is in immediate fluid connection 18*a* with primary pressure lines 12*a* and 12*b*, the higher normal pressure level of lines 12*a* and 12*b* maintain a steady state normal pressure in secondary line 18 of about 25–35 psi, thus stemming flow of air from valve 17.

With opening of demand valve 13 during inhaling, the pressure in lines 12*a–c* and 18 begins to reduce and air flows through valve 11 to maintain the primary system pressure at the defined range. With balancing of the defined pressure at which air flows through valve 17, the sizing of lines 12*a*, 12*b* and 12*c*, and the defined pressure to be sustained for normal pressurization of lines 12*a*, 12*b* and 12*c* by flow through valve 11, the system can be tuned so that air does not flow from the secondary air source through secondary valve 17 under normal durable primary system operation.

Upon failure of the durable system to provide sufficient flow from the primary source to maintain pressurization above about the level of the secondary system activation, air from the secondary source flows through valve 17 and into line 12*a* and 12*b*. With such failure of flow from the primary source, check valve 15 closes and the secondary source becomes a closed circuit operative emergency life sustaining system separate from the primary air source. In the illustration of FIG. 1, warning means 19 engages upon flow from secondary air container 16, to provide the user with a timely warning of primary system interruption.

FIG. 2 illustrates a system embodiment wherein compressed air cylinder 20 comprises the primary air source being in fluid connection with pressure valve 21 which is arranged to meter air from compressed air cylinder 20 into primary pressure lines 22*a–d*, in a flow sufficient to maintain a pressure of about 25–35 psi within lines 22*a–d*. Demand valve 23 is positioned proximate to or at user interface 24, and is user respiratory demand operative. When the user inhales, valve 23 acts to allow flow of air from primary passageway 22*a* through the user interface and acts to restrain flow when the user holds a breadth or exhales.

Check valve 25 is arranged open, allowing the flow of air through primary pressure line 22*b* to line 22*a* when the pressure in line 22*a* is less than the pressure in line 22*b*. Compressed air cylinder 26 of the secondary air system is in fluid connection with pressure valve 27 which meters air from compressed air cylinder 26 into secondary pressure line 28 in a flow sufficient to maintain a pressure of about 10–15 psi within line 28. As secondary line 28 is in fluid connection 28*a* with primary pressure lines 22*a* and 22*b*, the higher normal pressure level of lines 22*a* and 22*b* maintain a steady state normal pressure in secondary line 28 of about 25–35 psi, thus stemming flow of air from valve 27.

With opening of demand valve 23 during inhaling, the pressure in lines 22*a–d* begins to reduce and air flows through valve 21 to maintain the primary system pressure at the defined range. With careful balancing of the defined pressure at which air flows through valve 27, the sizing of lines 22*a–d*, and the defined pressure to be sustained for normal pressurization of lines 22*a–d* by flow through valve 21, the system can be tuned so that air does not flow from the secondary source through secondary valve 27 under normal durable primary system operation.

Quick disconnect device 29 comprises a manual means for disconnecting the primary air source from the system. Disconnect, interrupts flow from the durable air source for maintaining pressurization above about the level of the secondary system activation and air flows from the secondary system into line 22*a* and 22*b* with check valve 25 closing to isolate the secondary system in a closed circuit system.

Optional check valves 44 and 9 are illustrated in the schematic of FIG. 2. Check valve 44 is arranged to close upon disconnect, to prevent air escape from the primary air source, an embodiment desirable in boating applications for reducing vision obstruction by bubbling in underwater emergencies. Check valve 9 illustrates optional means for restraining air flow between disparate pressure sides of the system.

FIG. 3 illustrates a system embodiment wherein compressed air cylinder 30 comprises the primary air source being in fluid connection with pressure valve 31 which is arranged to meter air from compressed air cylinder 30 into primary pressure lines 32*a–c*, in a flow sufficient to maintain a pressure of about 25–35 psi within lines 32*a–c*. Demand valve 33 is positioned proximate to or at user interface 34, and is user respiratory demand operative. When the user inhales, valve 33 acts to allow flow of air from primary passageway 32*a* through the user interface and acts to restrain air flow when the user holds a breadth or exhales.

Check valve 35 is illustrated as being arranged integral to quick release device 39 and is open to allow a flow of air through primary pressure line 32*b* to line 32*a* when the pressure in line 32*a* is less than the pressure in line 32*b* and the quick release device is coupled. Compressed air cylinder 36 of the secondary air system is in fluid connection with pressure valve 37 which meters air from compressed air cylinder 36 into secondary pressure line 38 in a flow sufficient to maintain a pressure of about 10–15 psi within line 38. As secondary line 38 is in fluid connection 38*a* with primary pressure lines 32*a* and 32*b*, the higher normal pressure level of lines 32*a* and 32*b* maintain a steady state normal pressure in secondary line 38 of about 25–35 psi, thus stemming flow of air from valve 37.

With opening of demand valve 33 during inhaling, the pressure in lines 32*a–c* begins to reduce, and air flows through valve 31 to maintain the primary system pressure at the defined range. With balancing of the defined pressure at which air flows through valve 37, the sizing of lines 32*a–c*, and the defined pressure to be sustained for normal pressurization of lines 32*a–c* by flow through valve 31, the system can be tuned so that air does not flow from the secondary source through secondary valve 37 under normal durable primary system operation.

Quick disconnect device 39 is illustrated as comprising check valve 35, manual means for disconnecting the primary air source from the system and other system disconnects such as communications and/or liquid nourishment systems. With disconnect, the durable system no longer provides air flow to maintain pressurization down to about the level of the secondary system activation, and air flows through secondary valve 37 from the secondary source into line 32*a* and 32*b*. At such disconnect of the primary system check valve 35 closes and the secondary system again becomes a closed circuit operative emergency life sustaining system.

In FIG. 3, Ambient air valve 40 is illustrated as being functionally positioned at user interface 34. In this schematic illustration, the ambient air valve is can be manually opened and/or closed by the user and demand valve 33 is adapted for continuous and/or respiratory demand air flow. The ambient air valve may be opened by the system user for ambient air respiration with or without a continuous and/or demand flow of air enabled through the demand valve. Thus, the user can use ambient air as a sole source of respiration or a mixture of ambient air and breathable air from the primary air source or any combination of the above.

Such arrangements with an ambient air valve are generally preferred where the user interface is a face shield or the like, particularly in automotive or boat racing environments, where the flow from the breathable air source can also provide a cooling utility and/or keep a face shield from fogging.

Quick disconnect device 39 is schematically illustrated as comprising a disconnect means for communications, depicting communications base station 41 as comprising the operative elections, with input through wiring 41*a* to quick release 39 and output through wiring 41*b* to a headset or the like (not shown) mounted to the user. Similarly, liquid nourishment supply 42 is shown as being interconnected through quick release 39 through feeding tube 42*a* and out feeding tube 42*b* to the user.

Figure 4:
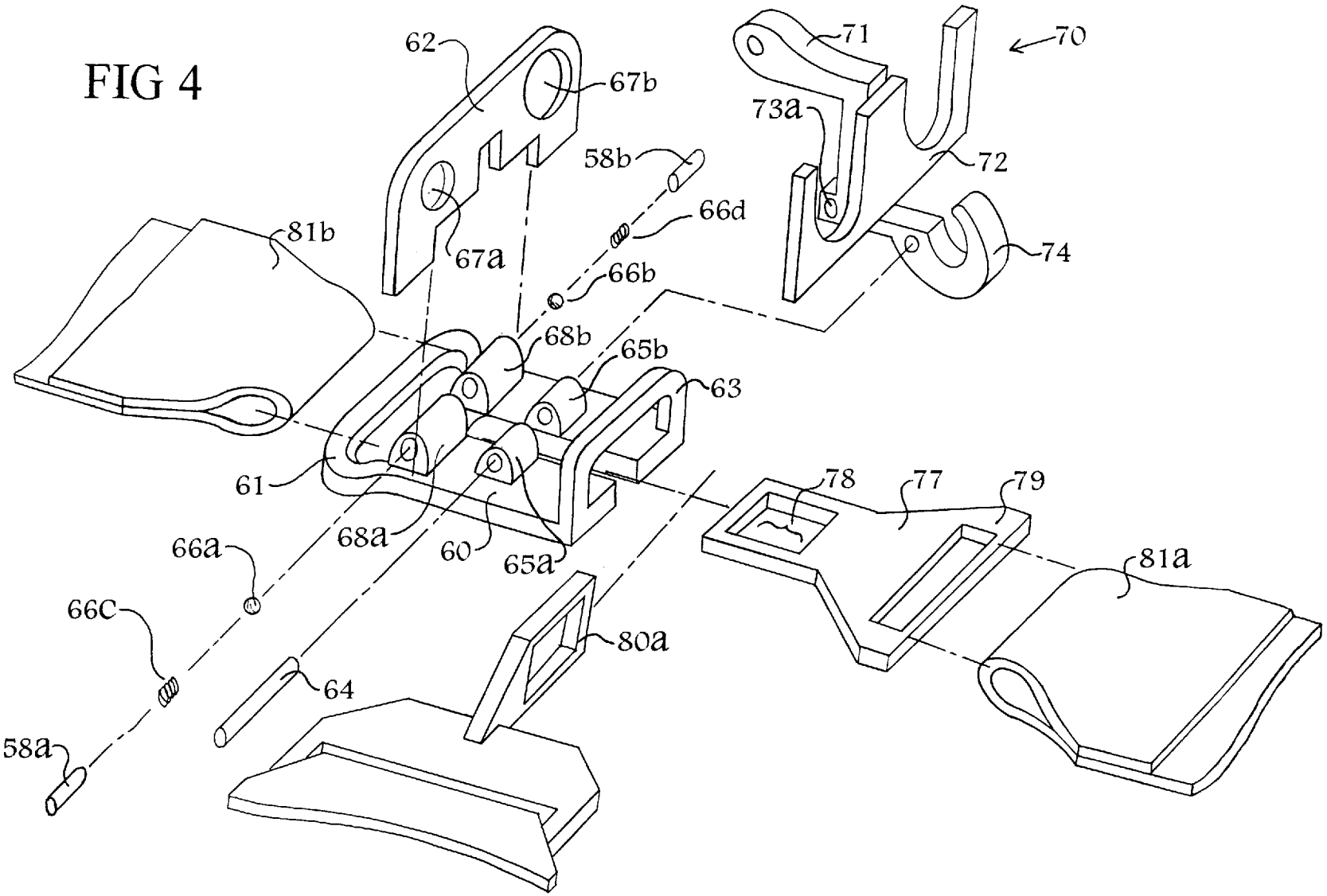
FIG. 4 is an exploded perspective view of a quick release device of the invention in a safety harness embodiment.

FIG. 4 illustrates a quick release device of the invention, embodied for use in a safety harness arrangement suitable for sports racing.

Therein, base 60 is illustrated as comprising lap belt attachment loop 61 for attachment of lap belt 81*b*, accessory mount 62, locking guide 63 and release actuator 70. Release actuator 70 is hingedly mounted to base 60 through pin 64 mounted in pin supports 65*a* and 65*b*. Detentes, comprising balls 66*a*,66*b* and springs 66*c*,66*d* are fixed by pin stops 58*a*,58*b* in detente supports 68*a* and 68*b* and engage corresponding detente rests in the release actuator. Slot 69 is sized to receive actuator 70.

Actuator 70 comprises release handle 71, interrupter plate 72, detente rests 73*a*,73*b* and lock hook 74. Detente rests 73*a* and 73*b* (not shown) are sized and positioned to engage balls 66*a* and 66*b* when actuator 70 is in the locked position to resist unwanted actuation of the release mechanism. Lock hook 74 is sized and positioned to pass through lock slot 78 of elongate release plate 77 and lock release plate 77 to base 60. Release plate 77 is dimensioned to extend from base 60 when locked to base 60 to accept restraining harness loops 80*a–c* along its length and comprises lap belt loop 79 for attachment of lap belt 81*a*.

Accessory mount 62 is illustrated as comprising holes 67*a* and 67*b* for mounting quick release connectors for compressed air and communications. It should be understood that the present invention contemplates multiple other connectors mountable through the accessory mount such as tube connectors for liquid nourishment, connectors for operator body monitoring means and the like.

Figure 5:
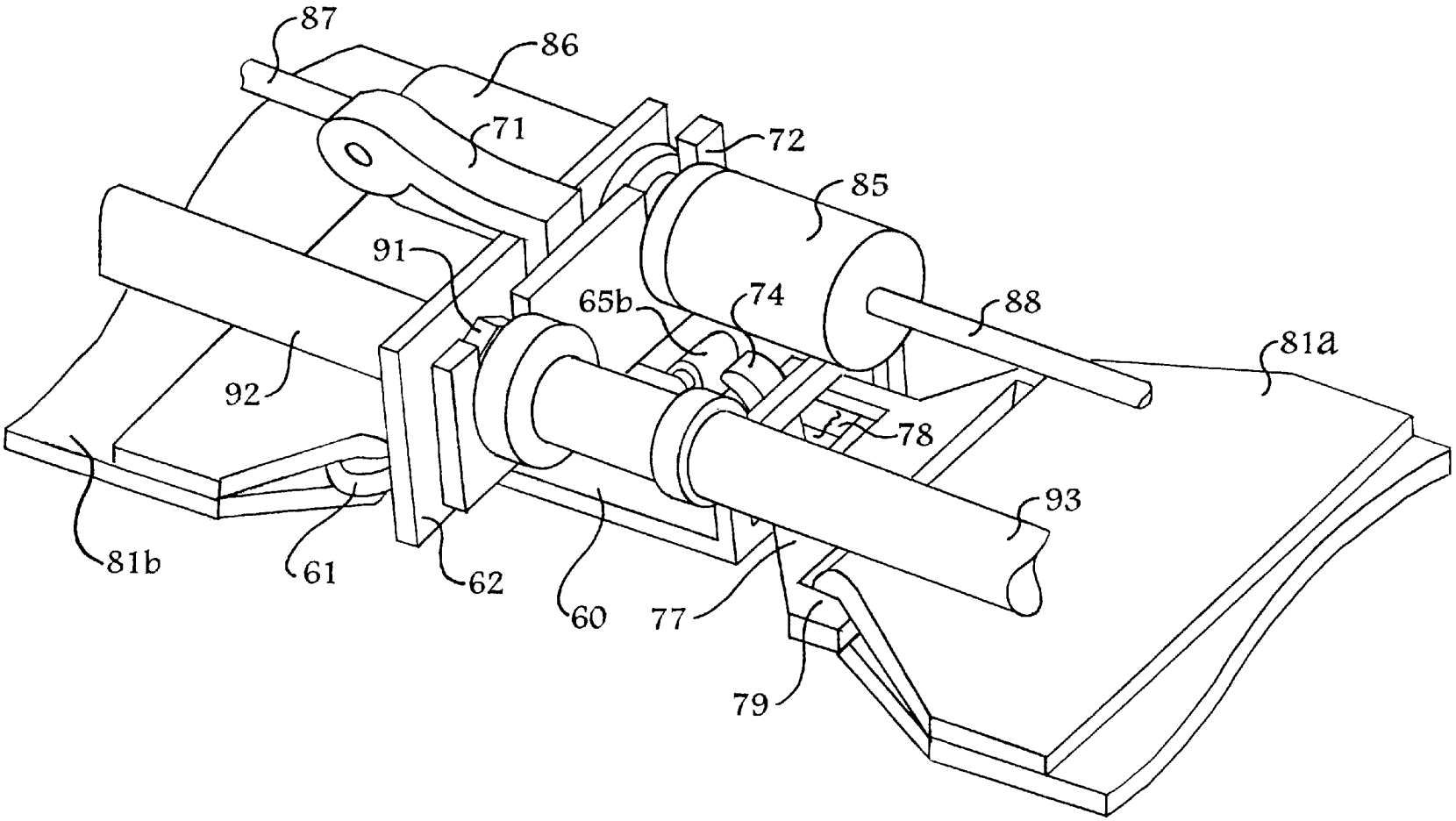
FIG. 5 is a perspective view of a quick release device of the invention with communication and air supply disconnect.

FIG. 5 illustrates an embodiment of the quick release device of FIG. 4 with communication connector, air supply connector and lab belt harness being depicted as connected. Therein, the communication connector is illustrated as comprising male member 85 and female member 86. Female member 86 is mounted to accessory mount 62 and connected with remote communications electronics through wiring 87. Male member 85 is releasably mounted to female member 86 and is connected with wiring 88 to a helmet, face mask or the like of the wearer. Release of male member 85 from the female connector and the quick release device occurs upon pivot of interrupter plate 72.

Similarly to the communication connector, the air supply connector is illustrated as comprising male member 90 and female member 91. Male member 90 is mounted to accessory mount 62 and connected to a remote main air supply source through hose 92. Female member 91 is releasably mounted to male member 90 and is connected by hose 93 to the personal air supply system of the wearer. Release of female member 91 from the male member 90 and the quick release device, occurs upon pivot of interrupter plate 72.

Figure 6:
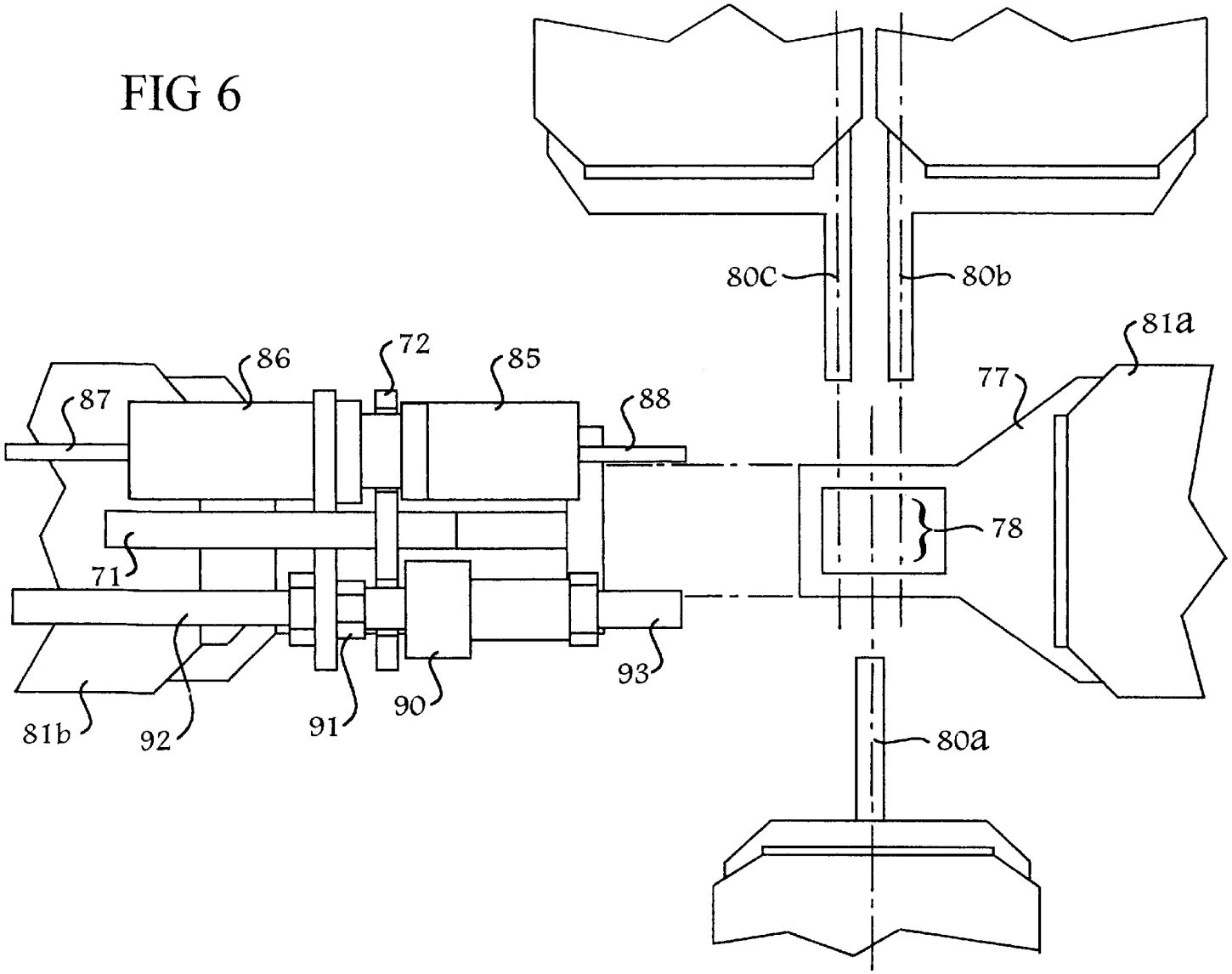
FIG. 6 is a top plan view of the device of FIG. 5 with fragmented safety harness attachments shown exploded.

FIG. 6 illustrates the embodiment of FIG. 5 in connected position, with communication connector, air supply connector and five point harness connection being depicted.

Therein, shoulder harness loops 80*b* and 80*c* and base belt loop 80*a* are shown as connecting along the length of release plate 77.

Figure 7:
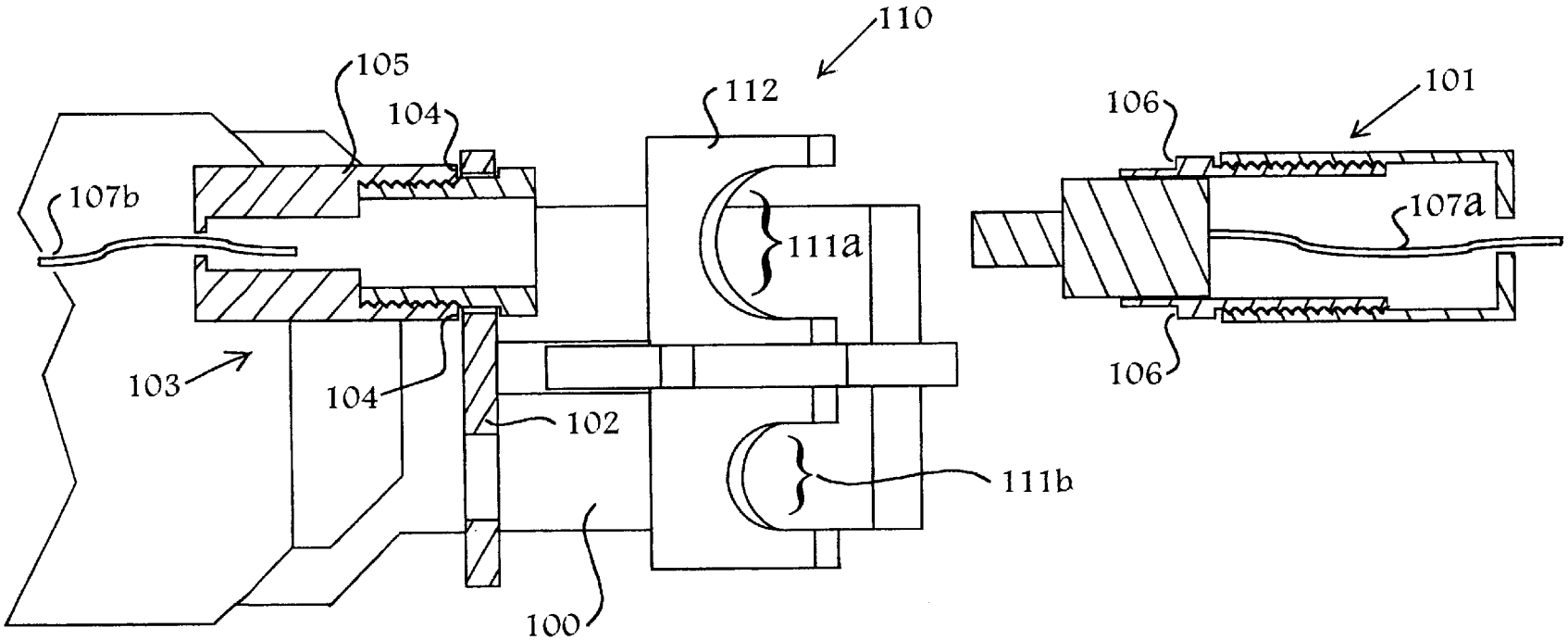
FIG. 7 is a fragmented, sectioned top plan view of a communication connector accessory during release of a quick release device of the invention.

FIG. 7 illustrates a fragmented, sectioned top plan view of a typical communication connector during quick release upon pivoting the actuator. Therein, the communication connector comprises female member 103 which extends through a hole in accessory mount 102 of base 100 and is held in place by ridge 104 and screw on casing 105. Actuator 110 is pivotally mounted (not shown) to base 100 and comprises slot 111*a* in interrupter plate 112. Male member 101 comprises wire 107*a* which connects with conducting leads (not shown) arranged to engage mating conducting receivers (not shown) connected to wire 107*b* of female member 103. The body of male member 101 is sized to loosely insert within slot 111*a* of interrupter plate 112, and comprises shoulder 106 which is dimensioned greater than slot 111*a*. Pivoting actuator 110 away from the female connector engages shoulder 106 of male member 101 pulling the male member from mating engagement with female member 103.

Figure 8:
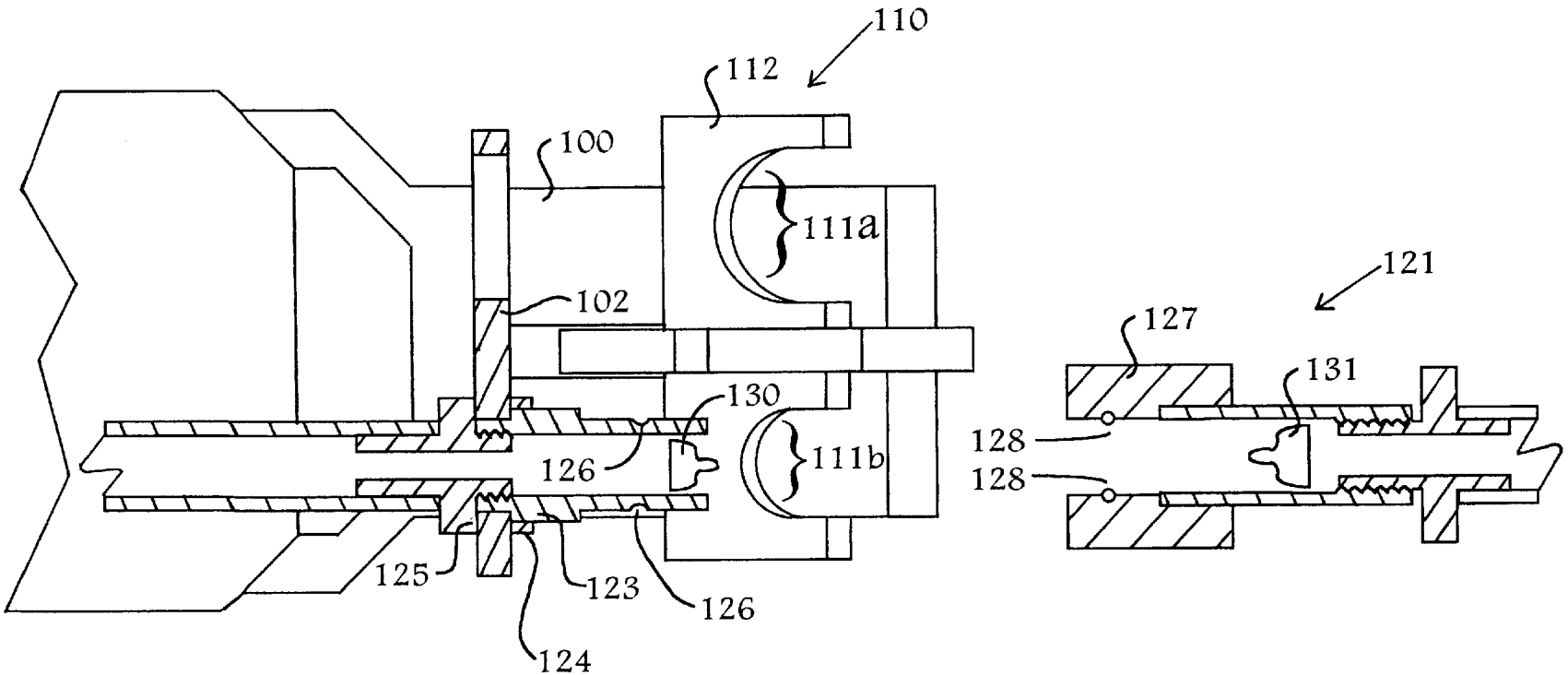
FIG. 8 is a fragmented, sectioned top plan view of an air connector accessory during release by a quick release device of the invention.

FIG. 8 illustrates a fragmented, sectioned top plan view of a typical primary air supply connector during quick release upon pivoting the actuator. Therein, actuator 110 is pivotally mounted (not shown) to base 100 and comprises slot 111*b* in interrupter plate 112. Air supply connectors are known in the prior art and comprise male member 123 which extends through a hole in accessory mount 102 of base 100, is held in place by mounting nut 124 and ridge 125, is sized to insert through slot 111*b* of actuator 110 and comprises ball slot 126. Male member 123 comprises check valve member 130 which is spring biased (not shown) to a closed air flow position. Female member 121 comprises check valve member 131 which is also spring biased (not shown) to a closed position. Check valve members 130 and 131 are arranged to engage upon mating of the male and female members in connected position with each member being displaced from a closed position to an open position to allow air flow.

Female member 121 comprises release ring 127 which is spring biased (not shown) to engage ball connectors 128, such that upon mating, release ring 127 holds ball connectors in ball race 126 of the male member. Release ring 127 is dimensioned larger than slot 111*b* and upon pivoting actuator 110 away from the male connector member engages release ring 127 displacing same from holding ball connectors in ball race 126 and releasing the male member from mating engagement with the female member. At release check valve members 130 and 131 are biased to a closed position to prevent flow of air therefrom.

Upon full pivoting action of the actuator, the quick release mechanism separates, shoulder and seat harness loops separate from the release plate and the operator is freed from restraint in his seat and connection to accessories mounted to the vehicle.

Although this invention has been described in detail, it is understood that it is by way of illustration and example only and is not to be taken by way of limitation, the sphere and scope of the invention being limited only to the terms of the appended claims.

We claim:

1. A release device comprising:

a base, arranged for attaching a belt thereto, said base having an accessory connector mounting means;

an accessory connector comprising mating elements in releasable axial aligned engagement, a first mating element of said connector being arranged to mount to said accessory connector mounting means;

release means, pivotally attached to said base, arranged for releasably engaging a release coupler;

disconnect means, mounted to coact with said release means and arranged to engage a second mating element of said connector;

wherein pivoting of said release means releases said release coupler from said base and coacts with said disconnect means to urge said second mating element from engagement with said first mating element.

2. The device of claim 1 wherein said base comprises a loop for attaching a belt therethrough.

3. The device of claim 2 wherein said release means comprises a latch which pivots through a slot in said base.

4. The device of claim 2 wherein said latch comprises a hook which pivots through a hole in the release coupler to engage said release coupler to the base.

5. The device of claim 1 wherein said accessory connector mount comprises a plate and a first mating element of said connector is mounted through a hole in said plate.

6. The device of claim 1 wherein two accessory connectors are mounted, spaced apart, to said accessory connector mount.

7. The device of claim 1 wherein said first mating element is one of air connector, electrical connector or tube connector element.

8. The device of claim 1 comprising an air connector having an air flow interrupting check valve means, in at least one of first and second mating elements, which is biased to close upon disconnect.

9. The device of claim 1 wherein a male element of an air connector is mounted to said accessory connector mount and a female element is engaged by said disconnect means.

10. The device of claim 9 wherein said female element comprises balls which engage a race in the male element.

11. The device of claim 1 wherein said disconnect means is attached to said release means and pivots with said release means.

12. The device of claim 11 wherein said disconnect means comprises a slot and a border of said slot is arranged to engage said second mating member and urge said second mating element from engagement with said first mating element.

13. The device of claim 1 wherein said release coupler is arranged to connect with a belt of a restraining harness.

14. The device of claim 13 wherein said release coupler is elongate and has a hole through which a latch of said release means can engage said release coupler.

15. The device of claim 13 wherein a belt of a restraining harness is arranged to connect to an end of said release coupler.

16. The device of claim 13 wherein a belt of a restraining harness is arranged to connect along the elongate of said release coupler.

* * * * *